United States Patent [19]

Holmes et al.

[11] 4,342,207

[45] Aug. 3, 1982

[54] SAFE RELOCK MECHANISM

[75] Inventors: Daniel L. Holmes, 913 Hoffman Blvd., Richmond, Calif. 94804; Tim Uyeda, Torrance, Calif.

[73] Assignee: Daniel L. Holmes, Richmond, Calif.

[21] Appl. No.: 131,155

[22] Filed: Mar. 17, 1980

[51] Int. Cl.[3] ..... E05B 63/14

[52] U.S. Cl. ..... 70/119; 70/118; 292/37

[58] Field of Search ..... 70/119, 133, 114–118, 70/120–123, 333 R; 292/37, 32

[56] References Cited

U.S. PATENT DOCUMENTS

| | | | |
|---|---|---|---|
| 826,607 | 7/1906 | Price | 70/118 X |
| 1,478,343 | 12/1923 | Looney | 70/116 |
| 1,530,655 | 3/1925 | Dowling | 70/116 |
| 3,158,017 | 11/1964 | Guze, Jr. | 70/119 |
| 3,760,618 | 9/1973 | Wiczer | 292/37 X |
| 4,233,913 | 11/1980 | Herrmann | 70/119 X |

*Primary Examiner*—William E. Lyddane

*Attorney, Agent, or Firm*—Harris Zimmerman; Howard Cohen

[57] ABSTRACT

In a safe locking mechanism including a spindle which rotates a cam plate to extend or withdraw a plurality of locking bolts, a novel relock mechanism includes a floating hard plate interposed between the inside surface of the safe door and the cam plate. A plurality of springs are disposed between the interior surface of the safe door and the floating hard plate to bias the hard plate toward the cam plate. Each of the locking bolts includes a chordal notch therein to engage the edge of the hard plate and prevent retraction of the locking bolts. The cam plate includes raised camming rails which engage raised buttons on the hard plate, so that rotation of the camming plate releases the hard plate from the notches in the locking bolts and permits the bolts to be withdrawn only by rotation of the spindle.

16 Claims, 13 Drawing Figures

SAFE RELOCK MECHANISM

BACKGROUND OF THE INVENTION

Although the art of designing and building safes is quite old, it seems that each new refinement which is intended to thwart unauthorized opening of a safe merely invites the application of new method and ingenuity to overcome the newest designs. Modern safes generally employ a plurality of locking bolts which extend from the safe door into apertures in the opening in the safe. The locking bolts are selectively withdrawn by rotation of a cam plate by a spindle which extends through the safe door to the exterior thereof. The spindle has a numbered dial on the exterior end thereof, and a plurality of combination wheels or tumblers on the interior end thereof. When all of the tumblers are properly aligned, a bail or fence which extends from the cam plate engages the aligned slot in the tumblers so that rotation of the dial and spindle will rotate the cam plate and withdraw the locking bolts to open the safe door.

Although safe doors and locking mechanisms appear formidable, ingenious burglars have devised simple methods for breaching the seemingly impregnable modern safe construction. For example, a burglar may use a hammer to knock the combination dial off of the exterior end of the spindle, and then use the hammer to drive the spindle axially inwardly to effect release of the locking mechanism. Another common method involves drilling into the safe wall adjacent to the door in the general area of the aperture which receives a locking bolt. The locking bolt may then be punched inwardly to thereby free the door and burglarize the contents of the safe. These methods may be countered by the use of massive construction of the safe parts, but this approach is extremely costly. In small safes for home or office use, where cost is an important consideration, the thickness and strength of the materials used tend to invite the burglarizing methods mentioned above.

SUMMARY OF THE PRESENT INVENTION

The present invention generally comprises a novel relock mechanism for use in conjunction with prior art safe locking mechanisms. It is particularly adapted to prevent release and retraction of the locking bolts of a safe door without proper actuation of the locking mechanism of the safe.

In a safe door which is releasably secured by a plurality of locking bolts extending therefrom into apertures in the wall of the safe, the present invention provides a floating hard plate disposed between the interior surface of the safe door and the safe locking mechanism. Generally speaking, the safe locking mechanism will include a plurality of combination wheels or tumblers disposed on the interior end of a spindle, with a cam plate which engages the locking bolts to selectively extend or retract the locking bolts. According to the present invention, the locking bolts are each provided with chordal notches in the interior ends thereof, the notches being adapted to engage a peripheral edge portion of the floating hard plate. A plurality of springs are disposed between the interior surface of the safe door and the floating hard plate to resiliently urge the hard plate to engage the notches of the locking bolts. The floating hard plate prevents retraction of the locking bolts, and defeats such burglarizing techniques as knocking off the combination dial and punching in the spindle to release the locking bolts. The engagement of the hard plate in the notches of the locking bolts also prevents a burglar from drilling into the safe wall adjacent to the door to gain access to the locking bolts and punch them inwardly to release the door.

To release the hard plate from its engagement with the locking bolts, the cam plate is provided with a plurality of annular raised camming tracks which are adapted to engage a like plurality of raised buttons extending from the hard plate. When the combination wheels are correctly aligned to release the lock mechanism, rotation of the camming plate causes the raised camming tracks to engage the buttons and urge the hard plate out of engagement with the notches in the locking bolts. The bolts are then free to retract into the safe door, as is known in the prior art, so that the door may be opened. It may be appreciated that only the proper actuation of the combination lock will release the hard plate to effect opening of the safe. Furthermore, it may be appreciated that the interposition of the hard plate between the interior surface of the safe door and the combination wheels creates a further barrier to mechanical intrusion through the safe door, such as drilling or the like.

A BRIEF DESCRIPTION OF THE DRAWING

DESCRIPTION OF THE PREFERRED EMBODIMENT

The present invention generally comprises a novel relock mechanism which is adapted for use in conjunction with a safe door locking mechanism. Although the preferred embodiment will be described in conjunction with a particular form of safe locking mechanism, it may be understood that the invention is not limited to use with any one particular type of locking device.

Figure 1:
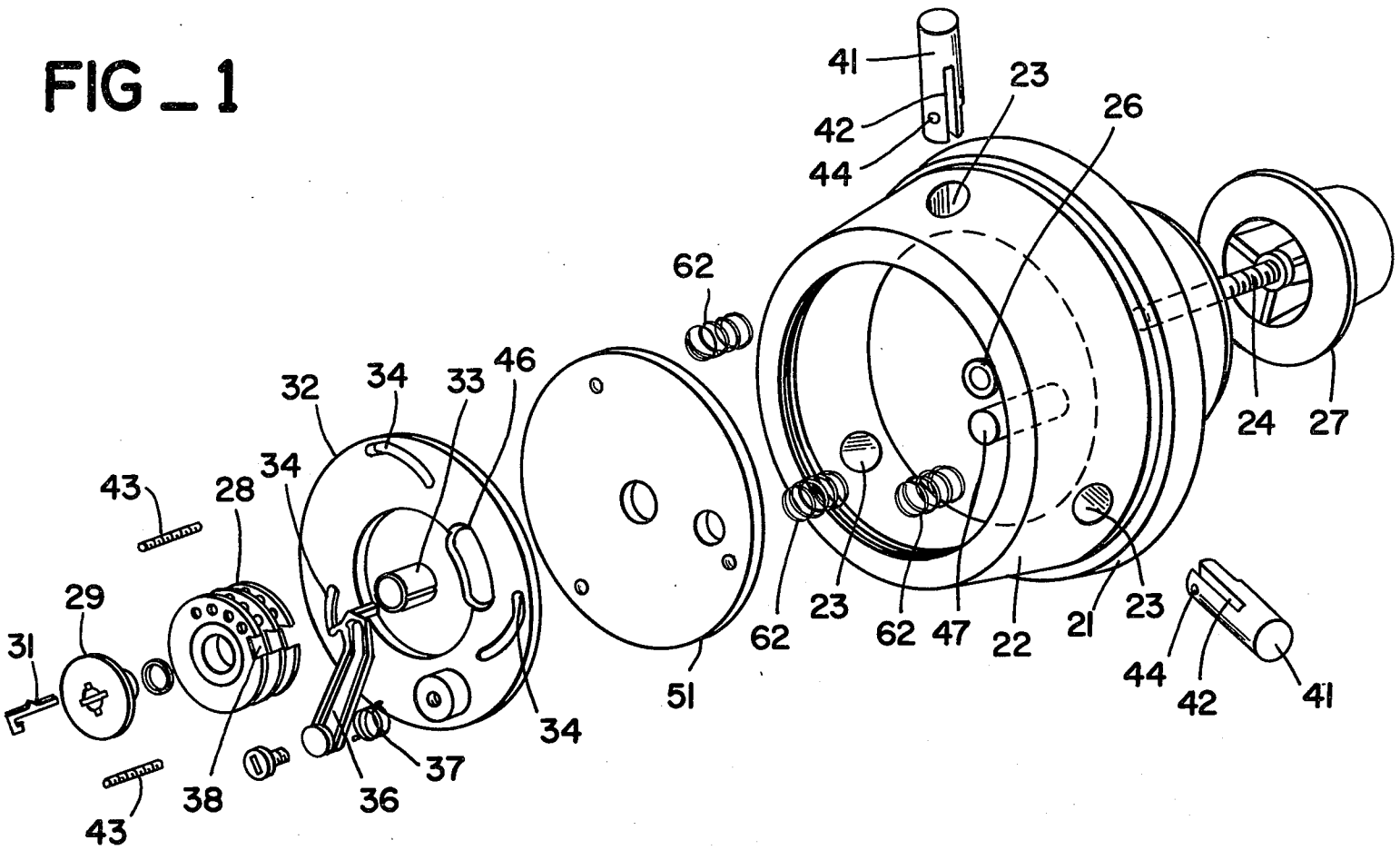
FIG. 1 is an exploded view of a safe locking mechanism incorporating the relock mechanism of the present invention.

As shown in FIG. 1, a safe door 21 includes a truncated conical portion 22 adapted to be received in a safe opening and including a trio of bolt holes 23 therein. The safe locking mechanism includes a spindle 24 extending through an axially disposed hole 26 in the safe door, with a combination dial 27 secured to the outer distal end of the spindle.

Joined to the proximal end portion of the spindle 24 are a trio of tumblers or combination wheels 28, the combination wheels being secured to the spindle by the threaded engagement of member 29 of the proximal threaded portion of the spindle. A spline key 31 is received axially in the member 29 and in a key way in the proximal end of the spindle to prevent rotation and loosening of the member 29.

The safe locking mechanism also includes a cam plate 32 having an axially disposed bushing 33 in which a medial portion of the spindle 24 is received in freely rotating fashion. The cam plate 32 includes a trio of camming slots 34 which subtend small angles and smoothly vary in radial distance from the axis of the cam plate. Joined to the inwardly facing surface of the camming plate is a bail or fence 36 which is biased by a helical spring 37 to be resiliently urged toward the tumblers 28. When the tumblers 28 are properly aligned by use of the combination dial 27, the inner end of the fence engages the aligned notches 38 of the tumblers. This engagement of the fence in the notches 38 transmits torque from the spindle 24 through the tumblers 28 and the fence 36 to the cam plate itself, so that the cam plate may be rotated.

The lock mechanism also includes a trio of locking bolts 41 which are slidably received in the holes 23. Each bolt 41 includes a longitudinally extending, diametrically disposed slot 42 which receives an edge portion of the cam plate 32. A screw 43 extends through a threaded hole 44 in each bolt, and also through one of the camming slots 34, so that each bolt 41 is joined to the plate 32. It may be appreciated that rotation of the cam plate 32 causes each camming slot 34 to act on the screw 43 of the respective bolt 41 to either extend or retract the bolt in the hole 23, according to the direction of rotation of the cam plate 32. Thus the angular position of the cam plate 32 determines whether the locking bolts 41 are extended or retracted. The cam plate 32 includes an annular slot 46 which subtends a small angle. A post or cam stop 47 extends inwardly from the inner face of the safe door 21 and is received in the annular slot 46 to limit the angular rotation of the cam plate 32.

It may be understood that all of the locking mechanism described in the foregoing is subject matter known in the prior art, and forms no independent part of the present invention. It is merely illustrative of a typical safe locking mechanism with which the present invention may be employed.

Figure 4:
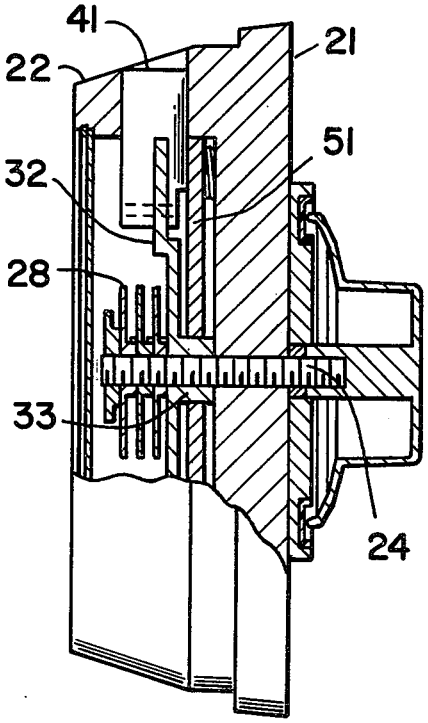
FIG. 4 is a partial cross sectional side view of a safe locking mechanism incorporating the present invention, shown in the unlocked position.
Figure 5:
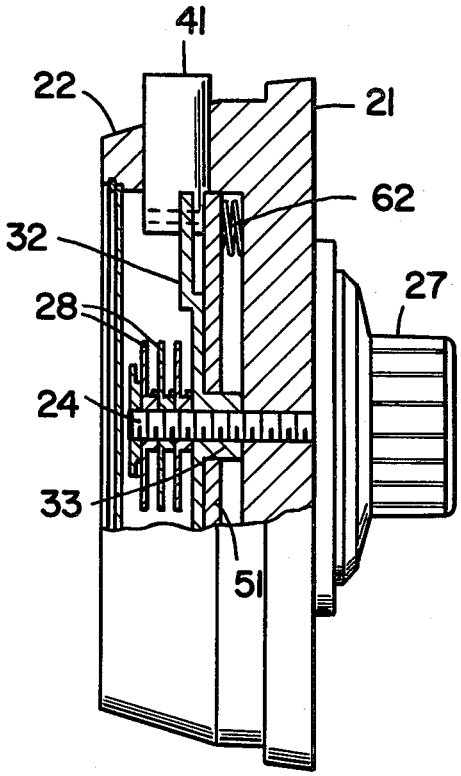
FIG. 5 is a partial cross sectional side view as in FIG. 4, shown in the locked position.
Figure 8:
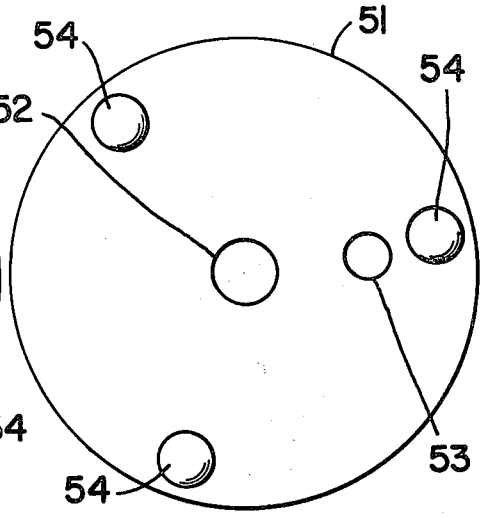
FIG. 8 is a plan view of the floating hard plate of the present invention.

A salient element of the present invention is a floating hard plate 51, shown in FIG. 1, comprising a generally circular disk of hard, durable material such as hardened steel or the like. As shown in FIG. 8, the hard plate 51 includes a central aperture 52 which is adapted to receive therein a portion of the bushing 33 of the cam plate 32, as shown in FIGS. 4 and 5. The plate 51 is substantially equal in diameter to the cam plate 32, and the bushing 33 is freely rotatable within the hole 52. The hard plate 51 also includes a hole 53 spaced radially outwardly from the hole 52 and adapted to receive therethrough the cam stop 47 which extends from the interior surface of the door 21. The engagement of the stop 47 in the hole 53 prevents rotation of the hard plate about the axis of the spindle 24.

The hard plate also includes a trio of protruding buttons 54, equilaterally spaced adjacent to the periphery of the plate. As shown in cross section in FIGS. 9 and 10, each button includes a stem 56 which is press fit into the hole provided in the plate. Each button includes a broad rounded head formed of a durable, low friction material such as PTFE or the like. The rounded heads of the buttons 54 are oriented to face the adjacent cam plate 32.

Figure 7:
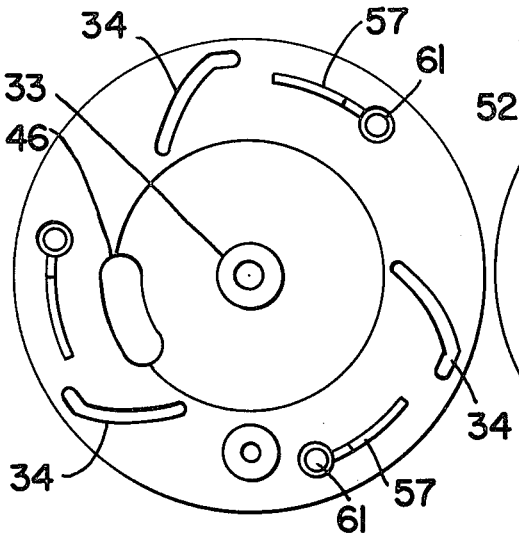
FIG. 7 is a plan view of the camming plate of the present invention.
Figure 11:
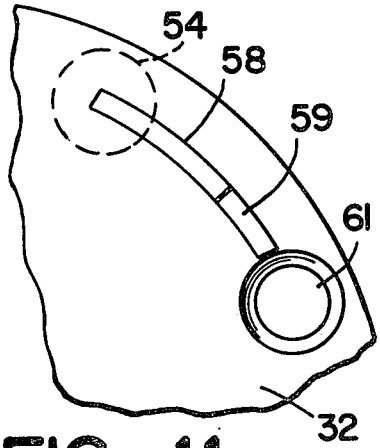
FIG. 11 is an enlarged fragmentary view of the camming plate of the present invention.

With reference to FIG. 7, the cam plate 32 is modified according to the present invention to include a trio of raised camming tracks 57 on the side thereof facing the floating hard plate 51. The tracks 57 are equilaterally spaced about the cam plate 32, and are substantially constant in radial distance from the axis of the plate. With reference to FIG. 11, each track 57 includes a raised portion 58 which protrudes uniformly from the plane of the plate 32, and a ramp portion 59 which slopes obliquely from the raised portion 58 to the plane of the plate 32. Adjacent to the distal end of the portion 59 of the track 57 is a detent depression 61, also shown in cross section in FIG. 9, which is sufficiently large in diameter to receive a significant portion of the head of a button 54.

The invention also includes a plurality of compression springs 62 disposed between the floating hard plate 51 and the interior surface of the safe door 21 to bias the hard plate toward the cam plate 32. The resilient biasing action of the springs 62 cause the buttons 54 to engage the camming tracks 57 and their adjacent detent depressions 61. It may be noted that since the buttons 54 are spaced at equal angles, and the camming tracks 57 and their associated detent depressions 61 are also disposed at equal angles, all of the buttons 54 will impinge on the like portions of the respective tracks 57 or detent depressions 61, depending on the rotational angle of the plate 32 with respect to the rotationally fixed hard plate 51.

Figure 10:
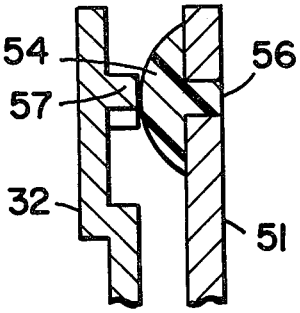
FIG. 10 is an enlarged cross sectional view of a portion of the camming plate and floating hard plate of the present invention shown in the engaged position.

For example, when the buttons 54 engage the detent depressions 61, the resilient force of the spring 62 will urge the plate 51 toward the cam plate 32 until the two plates are impinging. When the cam plate 32 is rotated, as explained in the foregoing description of the locking mechanism, the ramp portions 59 of the tracks 57 impinge on the protuding buttons 54 to urge the plate 51 away from the plate 32. Further rotation of the plate 32 causes the portions 58 of the tracks 57 to engage the buttons 54, causing the plate 51 to become spaced apart from the cam plate 32 as shown in FIG. 10.

Figure 12:
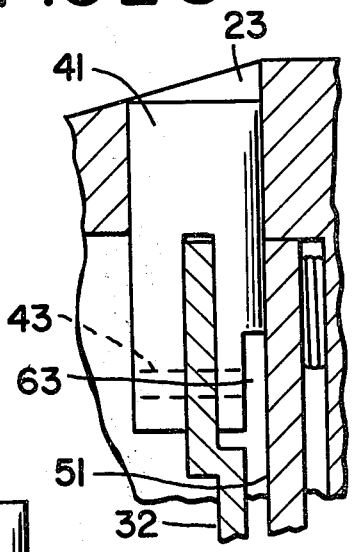
FIG. 12 is a fragmentary cross sectional view showing a locking bolt and the floating hard plate in the disengaged position.
Figure 13:
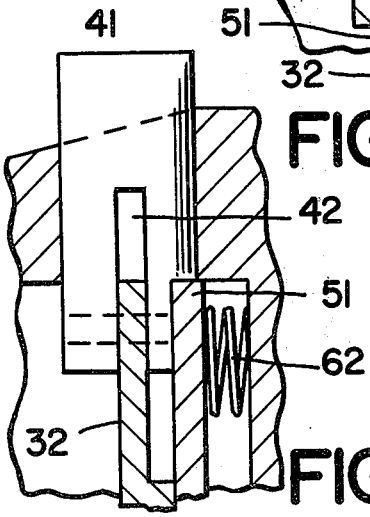
FIG. 13 is a fragmentary view showing a locking bolt and the floating hard plate in the engaged, locked position.

With reference to FIGS. 12 and 13, each locking bolt 41 is provided with a chordally extending notch 63 in a proximal portion thereof. It may be noted that the chordal surface of the notch 63 is substantially co-planar of the surface of the cam plate 32 which is adjacent to the hard plate 51.

When the cam plate 32 is rotated to extend the locking bolts 41, the notches 63 are positioned to receive peripheral edge portions of the hard plate 51, as shown in FIG. 13. The resilient pressure of the compression springs 62 urges the plate 51 to engage the notches 63, and to maintain that engagement. The locking bolts 41 are thus prevented by the hard plate 51 from retracting to the unlocked position. Indeed, the engagement of the plate 51 in the notches 63 prevents the locking bolts from being driven radially inwardly to free the safe door, as is often attempted by burglars. Likewise, the common burglary technique of driving the spindle axially inwardly to destroy and free the tumbler mechanism will not free the hard plate 51 from its engagement in the notches 63, so that this burglary technique also will be defeated.

Figure 9:
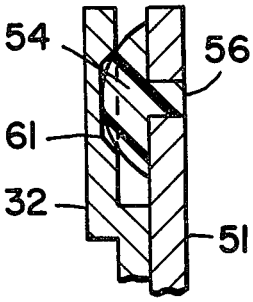
FIG. 9 is an enlarged cross sectional view of a portion of the camming plate and floating hard plate of the present invention.

In the disposition of the hard plate shown in FIG. 13, the hard plate is impinging on a major portion of the cam plate 32. This disposition corresponds to the operative disposition of the buttons 54 and camming tracks 57 as shown in FIG. 9; i.e., the buttons 54 are received in the detent depressions 61 to permit the plate 51 to be resiliently biaised to engage the notches 63. Rotation of the cam plate 32 to retract the locking bolts 41 causes the buttons 54 to engage the raised track portions of the camming track 57, driving the plate 51 in the axial direction away from the cam plate 32. The hard plate 51 is thus disengaged from the notches 63, and the bolts 41 may be withdrawn into their respective holes 23 as shown in FIG. 12.

With reference to FIG. 7, it may be noted that the angle subtended by the annular portions of the camming tracks 34 (constant radius portions) is substantially equal to the angle subtended between the centers of the detent depression 61 and the junction of the ramped camming surface 59 with the raised camming surface 58. Thus as the cam plate 32 is rotated clockwise, as seen in FIG. 7, the buttons 54 are engaged by the track portions 59 to drive the hard plate 51 of engagement with the notches 63, while the locking bolts 34 remain radially stationary in the extended position. The camming tracks 34 begin to retract the locking bolts 41 only after the plate 51 is freed from its blocking engagement with the notches 63 of the locking bolts.

Figure 3:
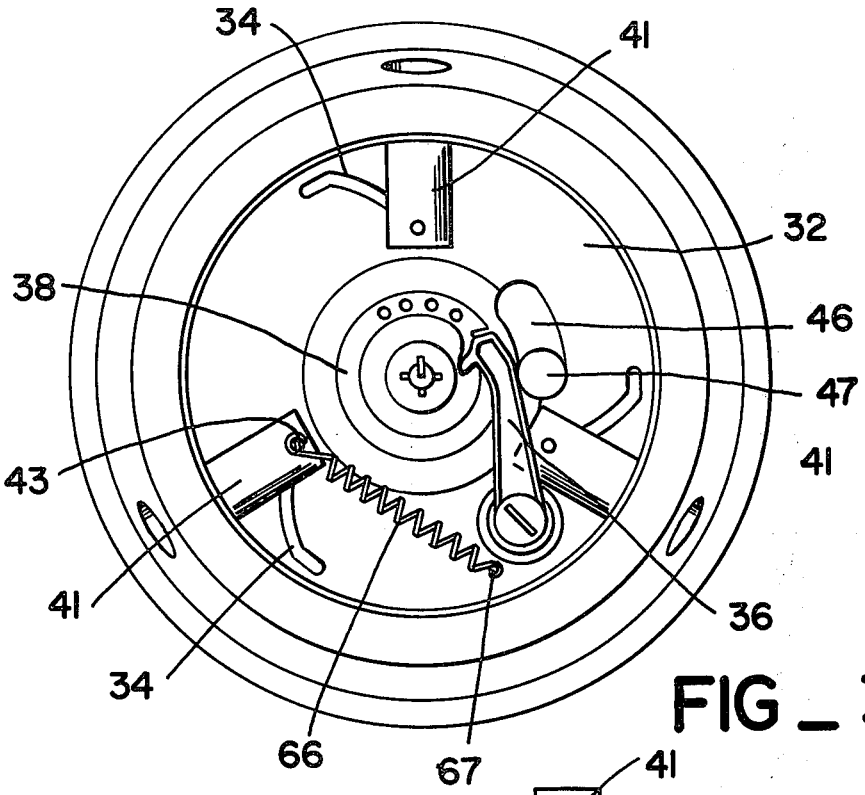
FIG. 3 is a plan view of the safe locking mechanism of FIG. 1, shown in the unlocked position.
Figure 2:
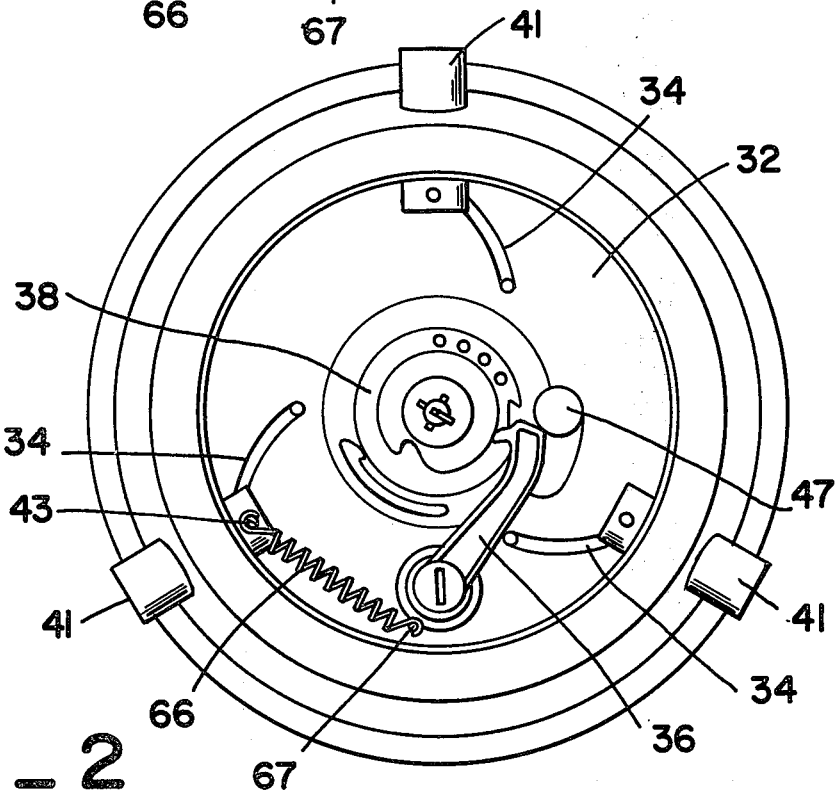
FIG. 2 is a plan view of the safe locking mechanism of FIG. 1, shown in the locked position.
Figure 6:
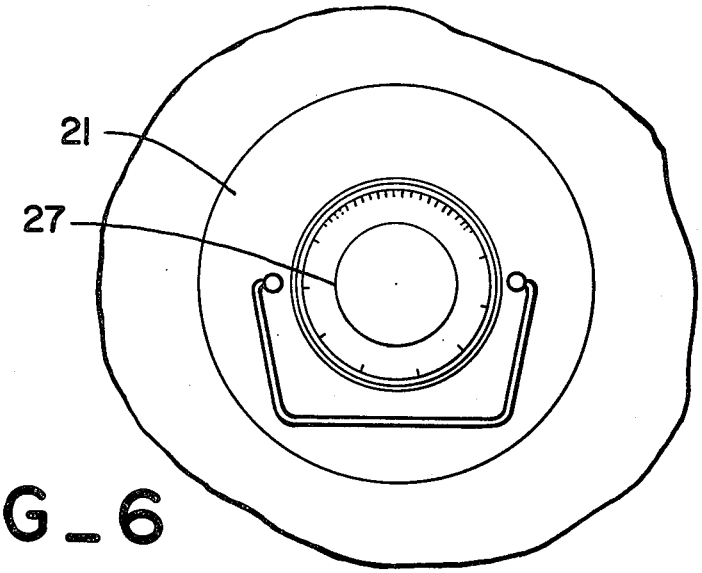
FIG. 6 is a front view of the safe locking mechanism shown in FIGS. 4 and 5.

With reference to FIGS. 2 and 3, the present invention also provides a helical tension spring 66 extending between a post 67 adjacent to the pivot of the fence 36 and a screw 43 of the adjacent locking bolt 41. The spring 66 applies a resilient restoring torque in the clockwise direction to the cam plate 32, as viewed in FIGS. 2 and 3. The torque applied by the spring 66 tends to urge the cam plate 32 clockwise from the retracted bolt position of FIG. 3 to the extended and locked bolt position of FIG. 2.

To describe the operation of the present invention in conjunction with the safe locking mechanism in the drawings, it is first assumed that the safe locking mechanism is in the locked position with the locking bolts 41 extending outwardly from the door 21, as shown in FIGS. 2, 5, and 13. To open the safe, the combination dial 27 is rotated as is known in the prior art to bring into alignment the notches 38 of the combination wheels 28. The aligned notches are engaged by the distal end of the fence 36, as shown in FIG. 3. Further rotation of the spindle in the counterclockwise direction as viewed in FIG. 3 applies counterclockwise torque to the cam plate 32 through the linking action of the fence 36. Initial rotation of the cam plate 32 causes the ramp portions 59 of the camming tracks 57 to engage the buttons 54 and drive the hard plate 51 out of engagement with the notches 63 of the locking bolts 41.

Further rotation of the cam plate 32 by rotation of the dial 27 and the spindle 24 causes the inwardly extending portions of the tracks 34 to retract the locking bolts 41 into their respective holes 23 in the tapered portion 22 of the safe door. When the bolts 41 are completely retracted, as shown in FIGS. 3, 4, and 12, the safe door may be removed to gain access to the contents of the safe.

The safe door may be relocked by merely rotating the spindle in the clockwise direction as viewed in FIGS. 2 and 3 to rotate the cam plate 32 in the clockwise direction in concert with the restoring force applied by the spring 66. The initial rotation of the cam plate 32 in the clockwise direction drives the locking bolts 41 radially outwardly into engagement with their respective ports in the safe opening. The buttons 54 then engage the downwardly sloping portions 59 of the camming tracks 57 to permit the resilient bias of the springs 62 to drive the hard plate 51 radially and engage the notches 63 in the locking bolts 41. The relocking of the safe mechanism is thus completed.

It may be noted that the only way to disengage the hard plate 51 from its blocking engagement with the notches 63 is by proper rotation of the cam plate 32. Burglarizing techniques such as attempting to punch inwardly the locking bolts 41 will have no effect on the blocking action of the hard plate 51, and will therefore fail. Likewise, attempting to drive the spindle inwardly to break and release the combination wheel mechanism will also fail to release the blocking engagement of the hard plate 51 and thus also will fail.

We claim:

1. In a safe locking mechanism which includes a plurality of retractable locking bolts extending from a safe door, said locking bolts being generally disposed in a common plane, a relock mechansim comprising a first plate disposed in the safe door and extending to said locking bolts, means on said locking bolts for releasably engaging peripheral edge portions of said first plate with said locking bolts in the extended position to block retraction of said locking bolts, means for urging said first plate toward said common plane to engage said means on said locking bolts, and means for disengaging said first plate from said locking bolts to permit retraction of said locking bolts by said locking mechanism.

2. The mechanism of claim 1, wherein said means on said locking bolts includes a notch in each of said locking bolts disposed to receive a peripheral edge portion of said first plate.

3. The mechanism of claim 2, wherein said notch in each of said locking bolts extends chordally in a proximal end portion of said locking bolt.

4. The mechanism of claim 1, wherein said locking mechanism includes a rotatable cam plate operatively joined to said locking bolts to extend and retract said locking bolts, and said first plate is disposed parallel and adjacent to said cam plate.

5. The mechanism of claim 4, further including means for preventing rotation of said first plate.

6. The mechanism of claim 4, further including spring means for urging said cam plate to rotate to extend said locking bolts.

7. The mechanism of claim 4, wherein said first plate is disposed between said cam plate and the inside surface of said safe door to protect said cam plate from penetrating intrusion through said safe door.

8. The mechanism of claim 4, wherein said means for disengaging said first plate from said locking bolts includes cam means on said cam plate for varying the spacing between said first plate and said cam plate.

9. The mechanism of claim 8, wherein said cam means includes at least one annular camming track on said cam plate.

10. The mechanism of claim 9, wherein said camming track protrudes from the surface of said cam plate which confronts said first plate.

11. The mechanism of claim 10, wherein said camming track includes a ramp portion extending smoothly outwardly from a flush relation with said surface of said cam plate to a constant height portion of camming track.

12. The mechanism of claim 9, further including at least one detent depression adjacent to one end of said annular camming track.

13. The mechanism of claim 12, wherein said first plate includes at least one cam follower for engaging said annular camming track and said detent depression.

14. The mechanism of claim 13, wherein said cam follower comprises a raised button on said first plate extending toward said cam plate.

15. In a safe locking mechanism which includes a plurality of retractable locking bolts extending linearly from a safe door, a relock mechanism comprising a non-rotatable first plate disposed in the safe door and extending to said locking bolts, means on said locking bolts for releasably engaging peripheral edge portions of said first plate with said locking bolts in the extended position to block retraction of said locking bolts, means for engaging said first plate and said means on said locking bolts independently of said locking mechanism, and means for disengaging said first plate from said locking bolts to permit retraction of said locking bolts by said locking mechanism.

16. In a safe locking mechanism which includes a plurality of retractable locking bolts extending from a safe door, a relock mechanism comprising a first plate disposed in the safe door and extending to said locking bolts, means on said locking bolts for releasably engaging peripheral edge portions of said first plate with said locking bolts in the extended position to block retraction of said locking bolts, means for disengaging said first plate from said locking bolts to permit retraction of said locking bolts by said locking mechanism, means for urging said first plate toward said means on said locking bolts to maintain said releasable engagement, said means on said locking bolts including a notch in each of said locking bolts disposed to receive a peripheral edge portion of said first plate, said notch extending chordally in a proximal end portion of each of said locking bolts, said locking mechanism including a rotatable cam plate operatively joined to said locking bolts to extend and retract said locking bolts, said first plate being disposed parallel and adjacent to said cam plate.

* * * * *